United States Patent [19]

Hattori et al.

[11] Patent Number: 4,554,032

[45] Date of Patent: Nov. 19, 1985

[54] WATER-IN-OIL EMULSION EXPLOSIVE COMPOSITION

[75] Inventors: Katsuhide Hattori; Yoshiaki Fukatsu; Hiroshi Sakai, all of Aichi, Japan

[73] Assignee: Nippon Oil and Fats Company, Limited, Tokyo, Japan

[21] Appl. No.: 645,080

[22] Filed: Aug. 28, 1984

[30] Foreign Application Priority Data

Sep. 5, 1983 [JP] Japan ..... 58-161880

[51] Int. Cl.[4] ..... C06B 45/02

[52] U.S. Cl. ..... 149/21; 149/2; 149/38; 149/40; 149/41; 149/42; 149/43; 149/44; 149/46; 149/47; 149/60; 149/61; 149/62; 149/70; 149/76; 149/77; 149/78; 149/83; 149/92; 149/110; 149/85

[58] Field of Search ..... 149/2, 21, 38, 40, 41, 149/42, 43, 44, 46, 47, 60, 61, 62, 70, 76, 77, 78, 83, 85, 92, 110

[56] References Cited

U.S. PATENT DOCUMENTS

| | | | |
|---|---|---|---|
| 4,315,784 | 2/1982 | Hattori et al. | 149/60 |
| 4,315,787 | 2/1982 | Hattori et al. | 149/2 |
| 4,326,900 | 4/1982 | Hattori et al. | 149/2 |
| 4,394,198 | 7/1983 | Takeuchi et al. | 149/61 |
| 4,398,976 | 8/1983 | Hattori et al. | 149/60 |
| 4,414,044 | 11/1983 | Takeuchi et al. | 149/60 |

*Primary Examiner*—Stephen J. Lechert, Jr.
*Attorney, Agent, or Firm*—Parkhurst & Oliff

[57] ABSTRACT

A water-in-oil emulsion explosive composition containing hollow microspheres obtained by firing volcanic ash and having a bulk density of 0.05–0.1 and an average particle size of 10–100 μm has improved explosion performance and safety over water-in-oil emulsion explosive composition containing conventional hollow microspheres.

1 Claim, No Drawings

WATER-IN-OIL EMULSION EXPLOSIVE COMPOSITION

BACKGROUND OF THE INVENTION (1) Field of the Invention

The present invention relates to a water-in-oil emulsion explosive composition containing a specifically limited gas-retaining agent, and more particularly relates to a water-in-oil emulsion explosive composition having a high performance and an improved safety.

(2) Description of the Prior Art

There has been used since about 10 years a slurry explosive, which is one of water-gel explosives, from the view point of the safety in the production and handling.

Slurry explosive is less sensitive than dynamite, which had been used before the development of slurry explosive, and is required to contain bubbles in an amount larger that contained in dynamite in view of the keeping of detonation sensitivity.

Since several years, there has been sold in the market a water-in-oil emulsion explosive, which is one of water-gel explosives but is different from the slurry explosive in the structure, that is, has a structure wherein an aqueous solution of inorganic oxidizer salt is wrapped with a film of carbonaceous fuel.

The above described slurry explosive uses sensitizers, such as monomethylamine nitrate, ethylene glycol mononitrate, ethanolamine mononitrate, ethylenediamine mononitrate, aluminum powder and the like, as an essential component in view of the keeping of explosion performance. However, the water-in-oil emulsion explosive does not require to use such sensitizer. Therefore, the use of bubbles in the water-in-oil emulsion explosive has increasingly become more important than the use of bubbles in the slurry explosive.

As the bubbles, there can be generally used bubbles mechanially (physically) mixed or blown into an emulsion explosive, bubbles formed in an emulsion explosive by a chemical foaming agent, bubbles mixed into an emulsion explosive by a gas-retaining agent, such as hollow microspheres, and the like. Among them, the former two kinds of bubbles leak during the storage of the explosive for a long time to deteriorate the detonation sensitivity and other properties of the explosive during the storage, and are disadvantageous.

As the water-in-oil emulsion explosive containing hollow microspheres, there are known water-in-oil emulsion explosives, wherein glass hollow microspheres are used (U.S. Pat. Nos. 4,141,767, 4,149,916, 4,149,917 and 4,216,040), and water-in-oil emulsion explosives, wherein resin hollow microspheres are used (U.S. Pat. Nos. 3,773,573 and 4,110,134). In these water-in-oil emulsion explosives, hollow microspheres having an average particle size of about 80–120 μm are generally used.

However, a water-in-oil emulsion explosive using hollow microspheres having the above described average particle size of about 80–120 μm are lower in the detonation velocity than a water-in-oil emulsion explosive using hollow microspheres having an average particle size smaller than about 80 μm and further have drawbacks that the explosive is high in bullet impact sensitivity, card gap sensitivity and the like, which are used as an indication of the safety of the explosive in its production.

While, in the glass hollow microspheres having a small average particle size, ones having a low bulk density (that is, ones having a relatively small shell thickness) result in a water-in-oil emulsion explosive composition having a poor resistance against dead pressing, and reversely ones having a high bulk density (that is, ones having a relatively large shell thickness) result in the explosive composition having a poor strength.

Further, resin hollow microspheres having a small average particle size are very poor in heat resistance, and therefore bubbles leak during the production of a water-in-oil emulsion explosive containing the resin hollow microspheres, resulting in an explosive having a poor explosion performance.

The inventors have made various investigations in order to overcome the drawbacks of water-in-oil emulsion explosive compositions containing conventional hollow microspheres, and found out that the use of specifically limited hollow microspheres results in a heat-resistant and safe water-in-oil emulsion explosive composition having improved explosion performances, such as detonation velocity, strength and the like, and have accomplished the present invention.

SUMMARY OF THE INVENTION

The feature of the present invention is the provision of a water-in-oil emulsion explosive composition, comprising a disperse phase consisting of an aqueous solution of inorganic oxidizer salts containing ammonium nitrate, a continuous phase consisting of a carbonaceous fuel, an emulsifier and a gas-retaining agent, the improvement comprising the gas-retaining agent consisting of hollow microspheres obtained by firing volcanic ash and having a bulk density of 0.05–0.1 and an average particle size of 10–100 μm.

DESCRIPTION OF THE PREFERRED EMBODIMENT

The aqueous solution of inorganic oxidizer salts consists mainly of ammonium nitrate and contains occasionally other inorganic oxidizer salts. As the other inorganic oxidizer salts, use is made of nitrates of alkali metal or alkaline earth metal, such as sodium nitrate, calcium nitrate and the like; chlorates, such as sodium chlorate and the like; perchlorates, such as sodium perchlorate, ammonium perchlorate and the like. The compounding amount of ammonium nitrate is generally 46–95% by weight (hereinafter, "%" means % by weight) based on the total amount of the resulting explosive composition, and the other inorganic oxidizer salts may be occasionally added to ammonium nitrate in an amount of not more than 40% based on the total amount of the mixture of ammonium nitrate and the other inorganic oxidizer salt.

The amount of water to be used for the formation of the aqueous solution of inorganic oxidizer salt is generally about 5–25% based on the total amount of the resulting explosive composition.

The carbonaceous fuel to be used in the present invention consists of fuel oil and/or wax. The fuel oil includes, for example, paraffinic hydrocarbon, olefinic hydrocarbon, naphthenic hydrocarbon, aromatic hydrocarbon, gas oil, heavy oil, lubricant, liquid paraffin and the like. The wax includes microcrystalline wax and the like, which are derived from petroleum; mineral wax, animal wax, insect wax, and the like. These carbonaceous fuels are used alone or in admixture. The compounding amount of the carbonaceous fuel is generally 0.1–10% based on the total amount of the resulting explosive composition.

The emulsifier to be used in the present invention includes any emulsifiers, which have hitherto been used in water-in-oil emulsion explosive, for example, fatty acid ester of sorbitan, mono- or di-glyceride of fatty acid, polyglycol ether, oxazoline derivative, imidazoline derivative, alkali metal or alkaline earth metal salt of fatty acid, and the like. The emulsifiers are used alone or in admixture. The compounding amount of the emulsifier is generally 0.1–10% based on the total amount of the resulting explosive composition.

The specifically limited gas-retaining agent to be used in the present invention consists of hollow microspheres obtained by firing volcanic ash and having a bulk density of 0.05–0.1 and an average particle size of 10–100 μm. The hollow microspheres obtained by firing volcanic ash are called as, for example, shirasu balloons or silica balloons, and are sold in the market.

When the average particle size of the hollow microspheres exceeds 100 μm, the bulk density thereof exceeds 0.1 correspondingly to the particle size, and hence the resulting water-in-oil emulsion explosive composition has a low detonation velocity, and the object of the present invention can not be attained. While hollow microspheres having a bulk density of less than 0.05 and concurrently having an average particle size of less than 10 μm are very difficult to be produced, and hence even when the hollow microspheres can be produced, they are expensive.

The compounding amount of the specifically limited gas-retaining agent is generally about 0.1–10%, preferably 0.5–5%, based on the total amount of the resulting explosive composition.

In the present invention, in addition to the above described ingredients, sensitizers, such as monomethylamine nitrate, aluminum powder and the like, can be occasionally contained in the explosive composition.

The water-in-oil emulsion explosive composition of the present invention is produced, for example, in the following manner. That is, a mixture of ammonium nitrate and other inorganic oxidizer salt is dissolved in water at a temperature of about 70°–100° C. to obtain an aqueous solution of the inorganic oxidizer salts. Separately, a carbonaceous fuel and an emulsifier are melted and mixed at about 70°–100° C. to obtain a mixture of carbonaceous fuel and emulsifier. Then, the mixture is first charged into a heat-insulating vessel having a certain capacity, and then the aqueous solution of the inorganic oxidizer salts is gradually added to the mixture while agitating the resulting mixture, to obtain a water-in-oil emulsion kept at about 70°–100° C. Then, the water-in-oil emulsion is mixed with the specifically limited gas-retaining agent defined in the present invention to obtain a water-in-oil emulsion explosive composition.

The following examples are given for the purpose of illustration of this invention and are not intended as limitations thereof. In the examples, "parts" and "%" mean by weight.

EXAMPLE 1

A W/O emulsion explosive composition having a compounding recipe shown in the following Table 1 was produced in the following manner.

To 11.34 parts of water were added 78.44 parts of ammonium nitrate and 4.73 parts of sodium nitrate, and the resulting mixture was heated to dissolve the nitrates in water and to obtain an aqueous solution kept at 90° C. of the inorganic oxidizer salts. Separately, 1.83 parts of an emulsifier of sorbitan oleate and 3.66 parts of paraffin were heated and melted to obtain a mixture kept at 90° C.

Into a heat-insulating vessel was charged the above obtained mixture, and then the above described aqueous solution of the inorganic oxidizer salts was gradually added thereto while agitating the resulting mixture by means of a propeller blade-type agitator. After completion of the addition, the resulting mixture was further agitated at a rate of about 1,600 rpm for 5 minutes to obtain a water-in-oil emulsion kept at about 90° C. Then, the water-in-oil emulsion was mixed with 3.5 parts of silica balloons (sold by Kushiro Sekitan Kanryu Co.) having a bulk density of 0.07 and an average particle size of 33 μm in a kneader while rotating the kneader at a rate of about 30 rpm, to obtain a water-in-oil emulsion explosive composition.

The resulting W/O emulsion explosive composition was used as a sample explosive and subjected to the following performance tests, and the detonation velocity, card gap sensitivity, projectile impact sensitivity, resistance against dead pressing in water, strength and heat resistance of the explosive composition were evaluated.

1. Measurement of detonation velocity:

A cartridge having an outer diameter of 25 mm and a length of 210 mm was produced from the sample explosive. A probe was inserted into the cartridge at a distance of 10 mm from its one end, and another probe was inserted into the cartridge at a position apart by 100 mm from the first probe. After the cartridge was adjusted to a temperature of 20° C., a No. 6 electric blasting cap was inserted into the other end of the cartridge, and the cartridge was detonated by the blasting cap. A passing time of the detonation wave between the two probes was measured by means of a counter. This measurement was repeated three times, and the average detonation velocity was calculated.

2. Card gap sensitivity test:

As a donor charge, a pentolite cartridge having a diameter of 30 mm and a length of 30 mm was used. As an acceptor charge, a cartridge produced from the sample explosive by packing directly the explosive in a polyvinyl chloride tube having an inner diameter of 30 mm and a length of 50 mm was used. As a gap material, a polymethyl methacrylate (PMMA) board was used.

In the card gap sensitivity test, an explosive which is detonated in a larger thickness of a gap board means that the explosive is detonated by a lower accept pressure, that is, the explosive has a higher sensitivity.

Accordingly, the card gap sensitivity of an explosive is evaluated by a relative value of the thickness of a gap board when the explosive has been detonated or not detonated.

The thickness of the gap board to be used in the experiment was increased by every 5 mm.

3. Test for projectile impact sensitivity:

The sample explosive was charged into a polyvinyl chloride tube having an inner diameter of 40 mm and a length of 50 mm. A flat faced projectile made of mild steel and having a diameter of 15 mm and a length of 15 mm was shot from a test gun (No. 20 gun) towards the tube, and whether the sample explosive was detonated or not by the impact of the flat faced projectile thereto was observed, and at the same time the projectile speed was measured by a laser system measuring apparatus.

An explosive which detonates in a lower projectile speed has a higher projectile impact sensitivity.

4. Test for dead pressing in water:

Ammonia gelatin-dynamite of 50 g weight was used as a donor charge, and the sample explosive of 100 g weight was used as an acceptor charge. The donor charge and the acceptor charge were arranged apart from each other in various distances in a depth of 1 mm beneath water surface. The donor charge was first detonated, and 500 msec after the detonation of the donor charge, the acceptor charge was detonated by applying an electric current to a No. 6 instantaneous electric blasting cap arranged in the acceptor charge.

As the distance between the donor charge and the acceptor charge is smaller, the acceptor charge is explosed to a higher pressure transmitted from the donor charge. As the result, bubbles in the acceptor charge are broken, and the detonation of the acceptor charge is difficult. That is, the acceptor charge exhibits the dead pressing.

By the above described method, the resistance of the acceptor charge against dead pressing was evaluated.

5. Mortar test:

The sample explosive of 10 g weight was packed in a tin foil, charged in a mortar, and detonated by a No. 6 industrial blasting cap. The strength of the sample explosive was compared with the strength, calculated as 100, of TNT.

In Table 1, the strength of the sample explosive is shown by a BM value (% TNT).

6. Test for heat resistance:

The sample explosive was formed into a cartridge having a diameter of 25 mm and a weight of 100 g, the cartridge was placed in a thermostat kept at 90° C., and a relation between the time elapsed in the thermostat of the explosive and the density thereof was measured, and further the detonability (20° C.) of the explosive was observed.

The results of the above described performance tests are shown in Table 1.

EXAMPLES 2–4

Water-in-oil emulsion explosive compositions were produced in the same manner as described in Example 1, except that silica balloons having a bulk density and an average particle size shown in Table 1 were used (all of the silica balloons are sold by Kushiro Sekitan Kanryu Co.).

The resulting water-in-oil emulsion explosive composition was used as a sample explosive, and the sample explosive was subjected to the same performance tests as described in Example 1. The obtained results are shown in Table 1.

COMPARATIVE EXAMPLES 1–5

Water-in-oil emulsion explosive compositions were produced in the same manner as described in Example 1, except that the hollow microspheres shown in Table 1 were used.

The resulting water-in-oil emulsion explosive composition was used as a sample explosive, and the sample explosive was subjected to the same performance tests as described in Example 1. The obtained results are shown in Table 1.

TABLE 1

| | | | (the numerical value of compounding recipe is indicated by parts by weight) | | | | | | | | |
|---|---|---|---|---|---|---|---|---|---|---|---|
| | | | Example | | | | Comparative example | | | | |
| | | | 1 | 2 | 3 | 4 | 1 | 2 | 3 | 4 | 5 |
| Ammonium nitrate | | | | | | | 78.44 | | | | |
| Sodium nitrate | | | | | | | 4.73 | | | | |
| Water | | | | | | | 11.34 | | | | |
| Sorbitan oleate | | | | | | | 1.83 | | | | |
| Paraffin | | | | | | | 3.66 | | | | |
| Hollow microspheres* | | | | | | | | | | | |
| Silica balloons | (0.07) | (33 μm) | 3.5 | — | — | — | — | — | — | — | — |
| Silica balloons | (0.07) | (55 μm) | — | 3.0 | — | — | — | — | — | — | — |
| Silica balloons | (0.06) | (80 μm) | — | — | 2.0 | — | — | — | — | — | — |
| Silica balloons | (0.09) | (20 μm) | — | — | — | 4.0 | — | — | — | — | — |
| GB, B 15/250 | (0.08) | (80 μm) | — | — | — | — | 3.0 | — | — | — | — |
| BG, B 28/750 | (0.17) | (80 μm) | — | — | — | — | — | 6.5 | — | — | — |
| RB | (0.02) | (45 μm) | — | — | — | — | — | — | 0.6 | — | — |
| Silica balloons | (0.12) | (560 μm) | — | — | — | — | — | — | — | 5.0 | — |
| Silica balloons | (0.15) | (270 μm) | — | — | — | — | — | — | — | — | 5.5 |
| Detonation velocity (m/sec) | | | 5,420 | 5,200 | 5,000 | 5,580 | 4,800 | 4,750 | 5,320 | 3,350 | 3,840 |
| Card gap sensitivity (mm) | | detonated | 30 | 30 | 40 | 25 | 40 | 40 | 30 | 45 | 45 |
| | | not detonated | 35 | 35 | 45 | 30 | 45 | 45 | 35 | 55 | 55 |
| Projectile impact | | detonated | 498 | 510 | 480 | 516 | 460 | 475 | 492 | 345 | 345 |
| sensitivity (m/sec) | | not detonated | 480 | 495 | 460 | 503 | 435 | 430 | 478 | 314 | 314 |
| Dead pressing in water (m) | | detonated | 0.7 | 0.7 | 0.7 | 0.7 | 1.7 | 0.7 | 0.7 | 1.0 | 0.8 |
| | | not detonated | 0.5 | 0.5 | 0.5 | 0.5 | 1.9 | 0.5 | 0.5 | 0.8 | 0.7 |
| BM value (% TNT) | | | 105 | 108 | 110 | 103 | 108 | 97 | 113 | 103 | 100 |
| Heat resistance | | | | | | | | | | | |
| bulk density | | | after 4 hrs. 1.15 | after 4 hrs. 1.16 | after 4 hrs. 1.17 | after 4 hrs. 1.14 | after 4 hrs. 1.10 | after 4 hrs. 1.12 | after 0.5 hr. 1.28 | after 4 hrs. 1.10 | after 4 hrs. 1.11 |
| Detonability (20° C.) | | | deto- | deto- | deto- | deto- | deto- | deto- | not | deto- | deto- |

TABLE 1-continued

| | (the numerical value of compounding recipe is indicated by parts by weight) | | | | | | | | |
|---|---|---|---|---|---|---|---|---|---|
| | Example | | | | Comparative example | | | | |
| | 1 | 2 | 3 | 4 | 1 | 2 | 3 | 4 | 5 |
| | nated | nated | nated | nated | nated | nated | detonated | nated | nated |

*Silica balloons are all sold by Kushiro Sekitan Kanryu Co.
BG, B 15/250 and B 27/750 are glass hollow microspheres sold by Minnesota Mining Manufacturing Co.
RB is resin hollow microspheres (vinylidene chloride type), trademark: Matsumoto Microsphere F-30, sold by Matsumoto Yushi Co.
The numerals in parentheses represent bulk density and average particle size.

It can be seen from Table 1 that the water-in-oil emulsion explosive compositions containing glass hollow microspheres (Comparative examples 1 and 2) are higher in card gap sensitivity and in projectile impact sensitivity, and are lower in resistance against dead pressing and in strength than the water-in-oil emulsion explosive compositions of the present invention (Examples 1–4).

Further, the emulsion explosive composition containing resin hollow microspheres (Comparative example 3) is poor in heat resistance, and hence the explosive composition is poor in detonability.

Even in the water-in-oil emulsion explosive compositions containing hollow microspheres obtained by firing volcanic ash, ones containing hollow microspheres having a bulk density and an average particle size outside the range defined in the present invention are higher in card gap sensitivity and in projectile impact sensitivity and are lower in detonation velocity than the water-in-oil emulsion explosive compositions of the present invention.

Accordingly, it is clear that the water-in-oil emulsion explosive composition of the present invention has improved explosion performance and safety over water-in-oil emulsion explosive compositions containing conventional hollow microspheres.

What is claimed is:

1. A water-in-oil emulsion explosive composition comprising:

a disperse phase consisting of an aqueous solution of inorganic oxidizer salts containing ammonium nitrate;

a continuous phase consisting of a carbonaceous fuel; an emulsifier; and, a gas-retaining agent, wherein said gas-retaining agent consists of hollow microspheres obtained by firing volcanic ash, said hollow microspheres having a bulk density of 0.05–0.1 and an average particle size of 10–100 μm.

* * * * *